US005586830A

United States Patent [19]

Wanek et al.

[11] Patent Number: 5,586,830

[45] Date of Patent: Dec. 24, 1996

[54] PIVOTING AND VARIABLE HEIGHT TABLE

[75] Inventors: Ronald G. Wanek; James C. Dotta, both of Arcadia; Brian Konkel, Mondovi; Duane Herold, Arcadia, all of Wis.

[73] Assignee: Ashley Furniture, Industries, Inc., Arcadia, Wis.

[21] Appl. No.: 349,533

[22] Filed: Dec. 5, 1994

[51] Int. Cl.[6] ..... F16B 7/10; F16D 1/00; B25G 3/18; A47B 9/00

[52] U.S. Cl. ..... 403/59; 403/104; 403/109; 403/322; 403/377; 108/144; 108/146; 248/407; 248/423

[58] Field of Search ..... 403/59, 104, 105, 403/109, 164, 321, 322, 327, 328, 365, 372, 376, 377; 108/144, 146, 148; 248/188.3, 407, 411, 414, 423

[56] References Cited

U.S. PATENT DOCUMENTS

| | | | |
|---|---|---|---|
| D. 178,739 | 9/1956 | Slavsky et al. . | |
| D. 238,844 | 2/1976 | Szucs . | |
| D. 328,824 | 8/1992 | Bellini et al. . | |
| 390,406 | 10/1888 | Sittig | 108/146 |
| 464,319 | 12/1891 | Parsons . | |
| 1,758,129 | 5/1930 | Shapiro . | |
| 1,885,597 | 11/1932 | Fehl et al. . | |
| 1,889,783 | 12/1932 | Harman . | |
| 1,916,537 | 7/1933 | Smith . | |
| 2,352,837 | 7/1944 | Hillenbrand . | |
| 3,054,122 | 9/1962 | Sarkus . | |
| 3,285,207 | 11/1966 | Vom Hagen . | |
| 3,469,870 | 9/1969 | Barkus . | |
| 3,715,997 | 2/1973 | Barth . | |
| 3,825,244 | 7/1974 | Bauer . | |
| 4,140,341 | 2/1979 | Rabe | 297/45 |
| 4,183,689 | 1/1980 | Wirges et al. . | |
| 4,401,036 | 8/1983 | Russo et al. . | |
| 4,607,577 | 8/1986 | Leonardo . | |
| 4,650,145 | 3/1987 | Natzel et al. . | |
| 4,672,898 | 6/1987 | Davidson . | |
| 4,693,442 | 9/1987 | Sills . | |
| 4,844,392 | 7/1989 | Bauer et al. . | |
| 4,899,969 | 2/1990 | Bauer et al. . | |
| 4,922,836 | 5/1990 | Damico . | |
| 4,997,165 | 3/1991 | Wiese | 256/59 |
| 5,016,846 | 5/1991 | Solomon . | |
| 5,020,752 | 6/1991 | Rizzi et al. . | |

*Primary Examiner*—Kenneth J. Dorner
*Assistant Examiner*—Bruce A. Lev
*Attorney, Agent, or Firm*—Peterson, Wicks, Nemer & Kamrath P.A.

[57] ABSTRACT

A device (10) is disclosed including a shelf (80) mounted to a lift tube (76) of a lift sub-assembly (74). An adjustment cone (88) is secured to the lower end of a rod (86) having its upper end pivotably secured to a handle (82) in turn pivotably secured adjacent the upper end of the lift tube (76). The lift tube (74) is slideable in cylindrical inner surfaces (58) of top and bottom bushings (50, 68) separated by positional spacers (66) having inner surfaces spaced from the lift tube (76). Indexing spacers (26) are slideably received and stacked end-on-end inside a vertical tube (18) below the bushings (50, 68) and the positional spacers (66). The lower ends of flexible fingers (92) of the adjustment cone (88) abut with an annular shoulder portion (36) formed in each of the indexing spacers (26) when the adjustment cone (88) is in its extended position relative to the lift tube (76) to prevent vertical movement therebeyond and allowing the ends of the fingers (92) to move in a circular path on the annular shoulder portion (36). In the retracted condition of the adjustment cone (88), the fingers (92) are pulled partially inside the lift tube (74) to a size which passes through the annular shoulder portions (36) without abutment. In the preferred form, the fingers (92) have a size which prevents passage through the cylindrical inner surface (58) of the bottom bushing (50) to prevent removal of the lift sub-assembly (74) from the vertical tube (18).

20 Claims, 2 Drawing Sheets

PIVOTING AND VARIABLE HEIGHT TABLE

BACKGROUND

The present invention generally relates to a device for allowing an object to be pivoted about a vertical axis and to be positioned at variable heights, specifically to a device for pivoting and variably adjusting the height of a table, and particularly to a device for pivoting a table over a bed or a movable nightstand at any desired height.

While reclining or sitting in bed, it is often desired to have a table positioned relative to the bed for providing a support for various objects such as food containers, writing tablets, or the like. Further, it is desirable that the table be located out of the way when it is not desired to be positioned relative to the bed. Additionally, it is desirable that the table can be positioned at variable heights depending upon the particular use of the table, the size and comfort of the user, and like factors. A table pivotable and height variable relative to a nightstand which is movable relative to the bed has been found to be a form of furniture which satisfies this market niche. With the increasing awareness of this type of furniture, an increasing need exists for devices for allowing tables or like objects to be pivoted about a vertical axis and to be positioned at variable heights and which are relatively inexpensive to fabricate and assemble, which are not prone to wear, which are easily operated, and which are relatively simple in design having minimal components and relatively few moving parts.

SUMMARY

The present invention solves this need and other problems in the furniture field by providing, in the most preferred form, at least first and second fingers movable between a first position of a size for movement in the inner passage of a vertical pillar and past annular shoulder portions therein and a second position of a size for abutting with one of the annular shoulder portions of the inner passage for preventing vertical movement of the fingers therebeyond and allowing the fingers to move on the annular shoulder portion in a circular path.

In a further aspect of the present invention, the pillar is formed by a plurality of indexing spacers stacked along a vertical axis in a vertical tube, with each of the spacers including an inner surface having an annular shoulder extending generally perpendicular to the vertical axis.

It is thus an object of the present invention to provide a novel device for allowing an object to be pivoted about an axis and variably positioned along that axis.

It is further an object of the present invention to provide such a pivotable and variable positioning device which is formed from relatively easily fabricated components.

It is further an object of the present invention to provide such a pivotable and variable positioning device which can be easily assembled.

It is further an object of the present invention to provide such a pivotable and variable positioning device which is not prone to wear.

It is further an object of the present invention to provide such a pivotable and variable positioning device which is easily operated.

It is further an object of the present invention to provide such a pivotable and variable positioning device including minimal components.

It is further an object of the present invention to provide such a pivotable and variable positioning device including relatively few moving parts.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
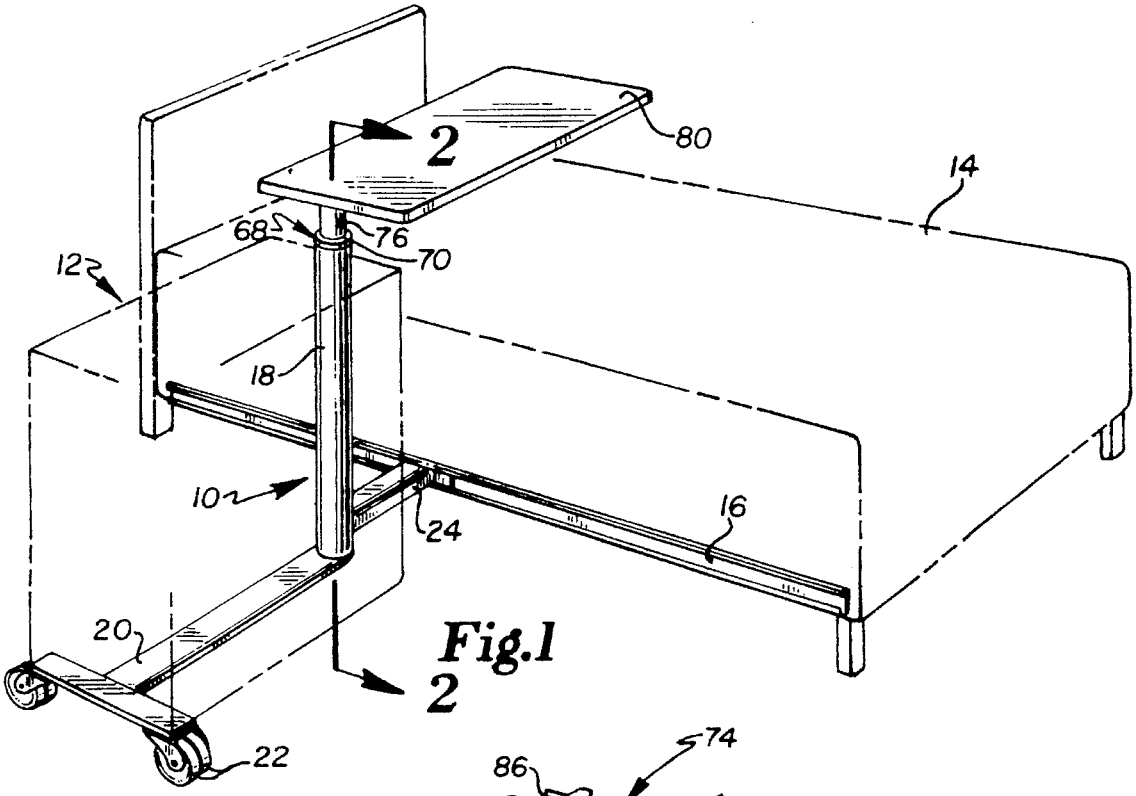
FIG. 1 shows a perspective view of a device for allowing a table to be pivoted about a vertical axis and to be positioned at variable heights relative to a bed and a movable nightstand according to the preferred teachings of the present invention, with portions shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "outer", "inner", "upper", "lower", "height", "width", "length", "end", "side", "horizontal", "vertical", "axial", "radial", "longitudinal", "lateral", and similar terms are used herein, it should be understood that these terms have reference only to the structure shown in the drawings as it would appear to a person viewing the drawings and are utilized only to facilitate describing the invention.

DESCRIPTION

A device for allowing a shelf or like object to be pivoted about a vertical axis and to be positioned at variable heights is shown in the drawings according to the preferred teachings of the present invention and generally designated 10. In the most preferred form of the present invention and as best seen in FIG. 1, device 10 is utilized in connection with a nightstand 12 which is movable relative to a bed 14. Specifically, bed 14 includes an elongated track 16 in which a carriage, not shown, is movably mounted. Device 10 includes a vertical tube 18 which is cylindrical in the most preferred form. A frame member 20 is secured to and extends generally perpendicular from the lower end of tube 18. Casters 22 are secured to the free end of frame member 20. The bottom of nightstand 12 rests upon and is secured to frame member 20 and one end of nightstand 12 abuts with tube 18, with nightstand 12 secured to tube 18 and frame member 20 by any suitable means. An arm 24 extends radially from tube 18 in a direction opposite to frame member 20 and in the preferred form slightly vertically above the lower end of tube 18. The outer, free end of arm 24 is suitably secured to the carriage movably mounted in track 16. Thus, nightstand 12 is supported and movable by casters 22 and the carriage.

Figure 3:
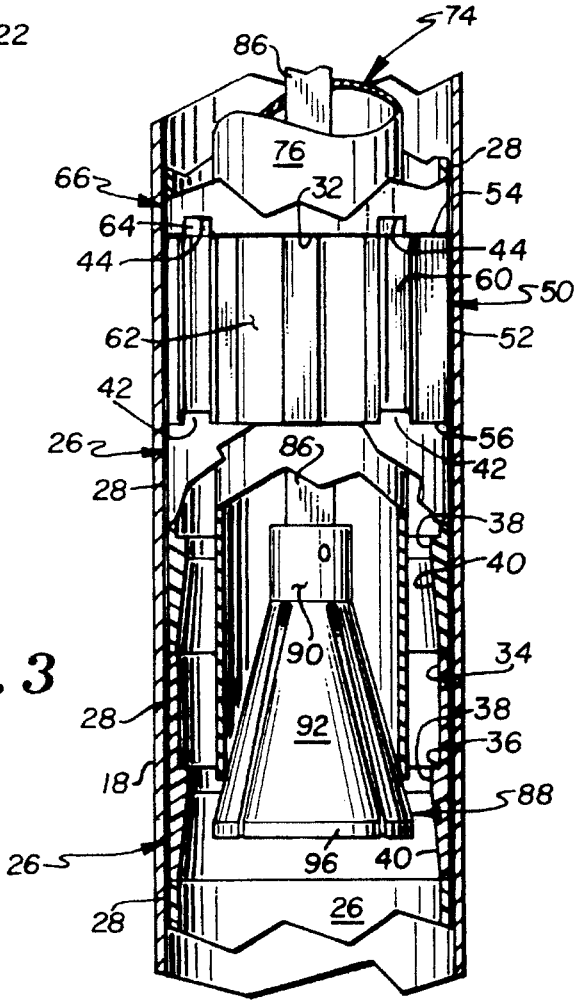
FIG. 3 shows a partial cross-sectional view of the table pivoting and variable height device of FIG. 1 with the fingers of the lift sub-assembly in their retracted position.
Figures 2, 4, 5:
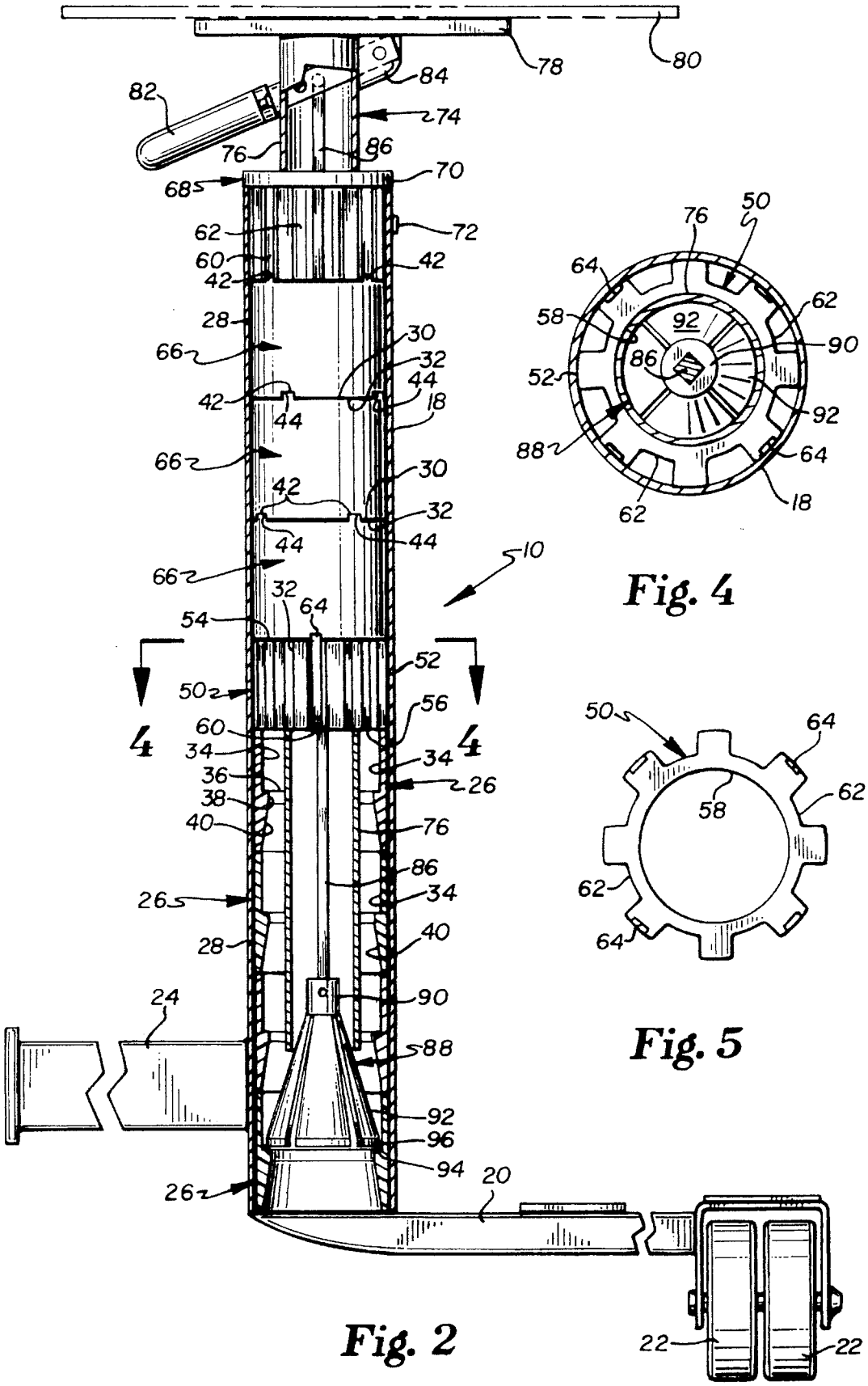
FIG. 2 shows a cross-sectional view of the table pivoting and variable height device of FIG. 1 according to section line 2—2 of FIG. 1 with the fingers of the lift sub-assembly in their extended position, with portions shown in phantom.
FIG. 4 shows a cross-sectional view of the table pivoting and variable height device of FIG. 1 according to section line 4—4 of FIG. 2.
FIG. 5 shows a top plan view of the bottom bushing of the table pivoting and variable height device of FIG. 1.

As best seen in FIGS. 2 and 3, device 10 according to the preferred teachings of the present invention includes a plurality of indexing spacers 26. Spacers 26 are generally tubular in configuration and include an outer surface 28 of a size and shape corresponding to and for slideable receipt inside tube 18 which is cylindrical in the most preferred form. Spacers 26 further include an upper end 30 and a lower end 32. The inner surface of spacer 26 includes a first portion 34 which in the most preferred form is cylindrical of a diameter less than that of surface 28. Portion 34 extends from upper end 30 towards but spaced from lower end 32 and in the most preferred form extends approximately midway between ends 30 and 32. The inner surface of spacer 26 further includes a second shoulder portion 36 which extends generally perpendicular to the vertical, longitudinal axis of spacer 26, of surface 28, and portion 34 and in the most preferred form having a radial thickness approximately double the radial thickness between surface 28 and portion 34. The inner surface of spacer 26 further includes a third portion 38 in the preferred form which is cylindrical in the most preferred form of a diameter equal to the inner edge of shoulder portion 36. In the preferred form, portion 38 extends from portion 36 towards but spaced from lower end 32 and in the most preferred form extends approximately 5% of the height between ends 30 and 32. The inner surface of spacer 26 further includes a fourth portion 40 of a decreasing size from portion 38 to end 32 and in the most preferred form is of a conical shape. Specifically, fourth portion 40 in the preferred form has a diameter and shape equal to the lower end of portion 38 at its interconnection thereto. Fourth portion 40 in the preferred form has a diameter and shape at end 32 equal to portion 34 at end 30.

In the most preferred form, end 30 has circumferentially spaced lugs 42 extending axially therefrom in a direction away from end 32. End 32 has circumferentially spaced cavities 44 extending axially therefrom in a direction toward end 30. Cavities 44 have a size, shape, and position for slideable receipt of lugs 42 in the most preferred form with a close tolerance fit. In the most preferred form, a plurality of spacers 26 are slideably received and stacked end-on-end along the vertical axis in tube 18, with end 32 of the lowest spacer 26 being supported above and in the preferred form on frame 20, with end 32 of the second lowest spacer 26 being supported on end 30 of the lowest spacer 26 with lugs 42 of the lowest spacer 26 received in cavities 44 of the second lowest spacer 26, and so on. In the most preferred form, lugs 42 are not in axial alignment with cavities 44 in each spacer 26.

In the preferred teachings of the present invention and as best seen in FIGS. 2–4, device 10 further includes a bottom bushing 50 which is generally tubular in configuration. In the preferred form, bushing 50 includes an outer surface 52 of a size and shape corresponding to and for slideable receipt inside tube 18 which is cylindrical in the most preferred form. Bushing 50 further includes an upper end 54 and a lower end 56. Bushing 50 also includes a cylindrical inner surface 58 of a diameter less than the inner edge of shoulder portion 36 of spacers 26 in the preferred form. Outer surface 52 includes circumferentially spaced troughs 60 extending axially the full height between ends 54 and 56. Troughs 60 have a size, shape, and position for slideable receipt of lugs 42 of spacers 26 in the most preferred form with a close tolerance fit. Outer surface 52 also includes circumferentially spaced cut-outs 62 extending axially the full height between ends 54 and 56 and circumferentially spaced from troughs 60. End 54 has circumferentially spaced lugs 64 extending axially therefrom in a direction away from end 56. Lugs 64 have a size, shape, and position for slideable receipt in cavities 44 in the most preferred form with a close tolerance fit. In the most preferred form, bushing 50 is slideably received in tube 18, with end 56 being supported on end 30 of the upper spacer 26 in tube 18, with lugs 42 of the upper spacer 26 received in troughs 60 of bushing 50.

As best seen in FIGS. 2 and 3, device 10 according to the preferred teachings of the present invention includes a plurality of positional spacers 66 stacked end-on-end in tube 18. In the most preferred form, positional spacers 66 are of identical construction to spacers 26. The end 32 of the lowest spacer 66 is supported on end 54 of bushing 50, with lugs 64 of bushing 50 received in cavities 44 of the lowest spacer 66.

As best seen in FIG. 2, device 10 according to the preferred teachings of the present invention further includes a top bushing 68. In the most preferred form, bushing 68 is generally of identical construction as bushing 50 but includes an annular lip 70 integrally secured to upper end 54 thereof. Annular lip 70 has a size and shape greater than outer surface 52 and generally equal and corresponding to the outer surface of tube 18. End 56 of bushing 68 is supported on end 30 of the upper spacer 66, with lugs 42 of the upper spacer 26 received in troughs 60 of bushing 68. Additionally, the lower axial end of lip 70 of bushing 68 abuts with and is supported on the upper end of tube 18. In the most preferred form, a set screw 72 extends through tube 18 and is threaded in bushing 68 to prevent slideable removal of bushing 68 from tube 18 and to prevent rotation of bushing 68 in tube 18. Due to the slideable receipt of lugs 42 and 64 in cavities 44 and troughs 60, it can then be appreciated that spacers 26 and 66 and bushing 50 are then also prevented from rotating in tube 18. Likewise, since spacers 26 and 66 and bushings 50 are sandwiched between frame 20 and bushing 68, axial sliding movement thereof within tube 18 is further prevented. Thus, it can be appreciated that tube 18 with spacers 26 and 66 and bushings 50 and 68 sandwiched therein of the most preferred form forms a vertical pillar having an elongated, vertically extending passage defined by inner surfaces 58 of bushings 50 and 68 and by portions 34, 36, 38, and 40 of spacers 26 and 66.

As best seen in FIGS. 2–4, device 10 according to the preferred teachings of the present invention further includes a lift sub-assembly 74. Specifically, sub-assembly 74 includes a lift tube 76 having a cylindrical outer surface of a diameter equal to and for slideable receipt in inner surface 58 of bushings 50 and 68. A mounting plate 78 is integrally secured to the upper end of lift tube 76 such as by welding. A table top or shelf 80 is secured to plate 78 by any suitable means such as screws and thus is operatively attached to sub-assembly 74 and each of the components thereof. A handle 82 extends through first and second axially extending elongated slots formed on diametrically opposite sides of tube 18 adjacent the upper end thereof. Handle 82 is pivotably mounted about a horizontal axis parallel to a tangent of the outer surface of tube 76 to an ear 84 secured to the outer surface of tube 76 and/or plate 78. A lift rod 86 is pivotably mounted to handle 82 about a horizontal axis parallel to the pivot axis of handle 82 to ear 84 and positioned inside of tube 76. In the most preferred form, rod 86 has square cross sections. Thus, by pivoting handle 82, rod 86 is reciprocated in tube 76 parallel to the longitudinal axis of tube 76. Rod 86 extends from handle 82 to closely adjacent the lower end of tube 76.

Sub-assembly 74 further includes an adjustment cone 88 having a collar 90 slideably received on the lower end of rod 86 and secured thereon such as by a spring pin. The first ends of a multiplicity of fingers 92 are integrally secured to collar 90, with fingers extending downwardly and outwardly from collar 90 and rod 86. The second ends of fingers 92 terminate in a flat surface 94 which is perpendicular to the axis of tube 76 when the outer surface of the second ends of fingers 92 have a diameter generally equal to first portion 34. In the most preferred form, the outer surface of the second ends of fingers 92 adjacent to flat surface 94 terminate in portions of a cylindrical surface 96 having a diameter generally equal to first portion 34 when flat surface 94 is perpendicular to the axis of tube 76. In the most preferred form, two pairs of fingers 92 are provided on opposite diametric sides of rod 86 and the vertical axis of tube 18. Fingers 92 are flexible such as by pivoting at collar 90 such that the second ends can move inwardly against their tendency or bias to move outwardly.

Handle 82 is pivotable between an upper position and a lower position to reciprocate rod 86 within tube 76. Due to its interconnection to handle 82 through rod 86, cone 88 is in a retracted position substantially within tube 76 as shown in FIG. 3 when handle 82 is in the upper position. In the upper or retracted position, the lower end of tube 76 abuts with the outside surfaces of fingers 92 and flexes them inward such that surface 96 has a diameter less than the diameter of the inner edge of shoulder portion 36. Cone 88 is in an extended position substantially outside of tube 76 when handle 82 is in the lower position. In the lower or extended position, fingers 92 are generally in a natural position such that surface 96 has a diameter equal to or greater than the diameter of first portion 34 with the lower end of tube 76 either being spaced from or abutting with the outer surface of fingers 92 intermediate their first and second ends.

In the preferred form and as shown in FIG. 3, surface 96 in the upper position has a diameter greater than the outer surface of tube 76 and inner surfaces 58 of bushings 50 and 68. Furthermore, in the most preferred form, surface 96 has a diameter greater than the outer surface of tube 76 and inner surfaces 58 of bushings 50 and 68 if fingers 92 are simultaneously forced inward due to the abutment together of the generally axially extending edges of fingers 92. It can then be appreciated that at least bushings 50 and 68 and spacers 66 must be slid on tube 76 prior to the assembly of sub-assembly 74 and specifically prior to the attachment of cone 88 in sub-assembly 74 as cone 88 is unable to slide through bushing 50 after assembly. Final assembly of device 10 and specifically positioning spacers 26 and 66 and bushings 50 and 68 within tube 18 is then accomplished after assembly of sub-assembly 74.

When handle 82 is in its lower position, surface 96 of fingers 92 abuts with the inner surface of spacers 26 and will slide downward therein until surface 94 abuts with shoulder portion 36 and surface 96 abuts with first portion 34 as shown in FIG. 2. Due to the cylindrical nature of first portion 34, inner surfaces 58, tube 76, and surface 96, surface 94 of fingers 92 is allowed to move on shoulder portion 36 in a circular path centered on the vertical axis and thus tube 76 and shelf 80 are able to rotate about a vertical axis lying along the longitudinal axis of the cylindrical shape of first portion 34, inner surfaces 58, tube 76 and surface 96. In the most preferred form shown, device 10 allows shelf 80 to act as a table and be positioned vertically above nightstand 12, vertically above bed 14, or at any desired rotational position therebetween.

According to the teachings of the present invention, shelf 80 can also be positioned at variable vertical heights. Specifically to lower shelf 80, handle 82 is pivoted from its lower position to its upper position to retract cone 88 within tube 76. In its retracted position as shown in FIG. 3, surface 96 is smaller than the diameter of the inner edge of shoulder portion 34 such that cone 88 and the end of tube 76 are able to pass the inner edges of shoulder portions 34 without engaging shoulder portion 34. Sub-assembly 74 can then be slid downward until shelf 80 is at roughly the desired vertical height. At that time, handle 82 can be pivoted from its upper position to its lower position to extend cone 88 outside of tube 76. In their extended position, fingers 92 flex outwardly towards their natural position until surface 96 engages the inner surface of spacer 26. It can then be appreciated that sub-assembly 74 will slide downward (typically under the force of gravity) until surface 94 engages with and abuts the next shoulder portion 36 vertically below surface 94 when handle 82 is pivoted to its lower position. At that time, surface 94 of fingers 92 abut with shoulder portion 36 to rotatably support shelf 80 at that vertical height and to prevent shelf 80 from moving vertically downward therebeyond.

When and if it is desired to raise shelf 80, handle 82 can be pivoted from its lower position to its upper position such that surface 96 has a size smaller than the inner edge of shoulder portions 34 as shown in FIG. 3. Then, sub-assembly 74 can be lifted to slide tube 76 in spacers 26 until shelf 80 is at roughly the desired vertical height. At that time, handle 82 can be pivoted from its upper position to its lower position to extend cone 88 outside of tube 76. In their extended position, fingers 92 flex outwardly towards their natural position until surface 96 engages the inner surface of spacer 26. It can then be appreciated that sub-assembly 74 will slide downward (typically under the force of gravity) until surface 94 engages with the next shoulder portion 36 vertically below surface 94 when handle 82 is pivoted to its lower position. At that time, surface 94 of fingers 92 abuts with shoulder portion 36 to rotatably support shelf 80 at that vertical height and to prevent shelf 80 from moving vertically lower. Alternately, without moving handle 82, sub-assembly 74 can be lifted to slide tube 76 in spacers 26. As tube 76 is slid, surface 96 will slide within first portion 34 of spacer 26 in which surface 94 originally abutted with shoulder portion 36 and then slide within fourth portion 40 of the next vertically upper spacer 26. Fourth portion 40 will then cam fingers 92 inward in a direction from their natural position. After the free ends of fingers 92 pass through third portion 38, fingers 92 will flex outwardly towards their natural position until surface 96 abuts with first portion 34 of spacer 26. Sub-assembly 74 can be raised until surface 94 is positioned above shoulder portion 36 at the desired height of shelf 80.

It can be appreciated that inner surfaces 58 of bushings 50 and 68 slideably support tube 76 inside of tube 18 for reciprocation parallel to the longitudinal axis of tube 18. Thus, tube 76 and cone 88 will always be centered in the inner surfaces of spacers 26 and 66. Further since the inner surfaces of spacers 26 and 66 are spaced from tube 76, sliding and rotational friction of tube 76 in tube 18 is minimized. Further, as set forth previously in the most preferred form, fingers 92 can not be flexed inwardly to a size smaller than inner surface 58 of bushing 50. Due to the capture of bushing 50 in tube 18 by its sandwiching with spacers 26 and 66 between frame 20 and bushing 68, bushing 50 prevents fingers 92 from being pulled through inner surface 58 of bushing 50 and thus prevents further removal of sub-assembly 74 therebeyond. Thus, the vertical position of sub-assembly 74 is restricted to where fingers 92 are at least partially located in spacers 26 and specifically intermediate frame 20 and bushing 50.

It can further be appreciated that device 10 according to the preferred teachings of the present invention is easily assembled from a minimal number of easily fabricated components which are not prone to wear. Specifically, the use of a plurality of spacers 26 and 66 and bushings 50 and 68 rather than a single component is advantageous in that the molds for spacers 26 and 66 and bushings 50 and 68 are less complex and there is less chance of warpage or other fabrication defects. In this regard, bushings 50 and 68 could be formed by extrusion to reduce capital costs. Additionally, tubes 18 and 76, rod 86, as well as other components are fabricated from off the shelf stock such that molds and other capital costs are minimized. Additionally, the relatively movable components, i.e. handle 82 relative to tube 76, rod 86 relative to handle 82, fingers 92 relative to each other and to spacers 26, and tube 74 relative to the internal passage of the vertical pillar formed by tube 18 and inner surfaces 58 of bushings 50 and 68 in the preferred form, are not prone to wear or breakage from use. Further, assembly of spacers 26 and 66 and bushings 50 and 68 together is simply accomplished by interfitting lugs 42 and 64 in cavities 44 and troughs 60 and their assembly with lift sub-assembly 74 in tube 18 is performed by their slideable receipt in tube 18 and the securement of set screws 72.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Device for allowing an object to be pivoted about a vertical axis and to be positioned at variable heights comprising, in combination: a vertical pillar having an elongated, vertically extending inner passage, with the inner passage including a plurality of vertically spaced, shoulder portions extending generally perpendicular to the vertical axis and having inner edges, with each of the shoulder portions being annular and centered and extending completely around the vertical axis; at least first and second fingers located on opposite diametric sides of the vertical axis, with the object being operatively attached to the fingers; and means for moving the fingers between a first position and a second position, with the fingers in the first position being of a size for movement in the inner passage and past the inner edges of the shoulder portions without engagement and in the second position being of a size for abutting with one of the shoulder portions for preventing vertically downward movement of the fingers therebeyond and for allowing the fingers to move on one of the shoulder portions in a circular path centered on the vertical axis.

2. The device of claim 1 wherein the vertical pillar comprises, in combination: a vertical tube; and a plurality of indexing spacers each including an outer surface of a size and shape corresponding to and for slideable receipt inside the vertical tube, an upper end, a lower end, and an inner surface, with the inner surface of each of the indexing spacers including the annular shoulder portion, with the plurality of indexing spacers being stacked along the vertical axis end on end in the vertical tube.

3. The device of claim 2 further comprising, in combination: a tubular bushing having a cylindrical inner surface, with the tubular bushing having an outer surface of a size and shape corresponding to and for slideable receipt inside the vertical tube; and wherein the moving means comprises, in combination: a lift tube having a cylindrical outer surface of a diameter for slideable receipt in the cylindrical inner surface of the tubular bushing, with the object being mounted on the lift tube.

4. The device of claim 3 wherein the fingers are biased from their first position to their second position; wherein the lift tube has a size for movement past the inner edges of the shoulder portions; and wherein the moving means further comprises, in combination: means for moving the fingers in the lift tube between a retracted position and an extended position, with the fingers in the extended position being in their second position, with the fingers in the retracted position being at least partially located in and abutting with the lift tube and being in their first position.

5. The device of claim 4 wherein the moving means comprises, in combination: a rod located in the lift tube; and means for reciprocating the rod within the lift tube, with the fingers secured to and movable with the rod.

6. The device of claim 5 wherein the reciprocating means comprises a handle pivotable about a horizontal axis, with the rod having an upper end opposite the fingers, with the upper end of the rod being secured to the handle spaced from the horizontal axis.

7. The device of claim 3 wherein the inner surface of each of the indexing spacers is of a size greater than the cylindrical inner surface of the tubular bushing; and wherein the fingers have a size in the first position which is unable to pass through the cylindrical inner surface of the tubular bushing.

8. The device of claim 3 wherein the spacers each include circumferentially spaced lugs extending axially from the upper end in a direction away from the lower end; and circumferentially spaced cavities extending axially from the lower end in a direction toward the upper end and having a size, shape, and position for slideable receipt of the circumferentially spaced lugs; and wherein the tubular bushing has an upper end and a lower end, with the circumferentially spaced lugs extending axially from the upper end of the tubular bushing; and wherein the tubular bushing includes circumferentially spaced troughs extending axially in the outer surface of the tubular bushing between the upper and lower ends of the bushing and having a size, shape, and position for slideable receipt of the circumferentially spaced lugs, with the circumferentially spaced lugs being circumferentially spaced from the circumferentially spaced troughs on the tubular bushing.

9. The device of claim 2 wherein the spacers each include circumferentially spaced lugs extending axially from the upper end in a direction away from the lower end; and circumferentially spaced cavities extending axially from the lower end in a direction toward the upper end and having a size, shape, and position for slideable receipt of the circumferentially spaced lugs.

10. The device of claim 1 wherein the inner passage includes a cylindrical inner surface of a size smaller than the inner edges of the shoulder portions; and wherein the moving means comprises a lift tube having a cylindrical outer surface of a diameter for slideable receipt in the cylindrical inner surface of the inner passage, with the object being mounted on the lift tube.

11. The device of claim 10 wherein the fingers are biased from their first position to their second position; wherein the lift tube has a size for movement past the inner edges of the shoulder portions; and wherein the moving means further comprises, in combination: means for moving the fingers in the lift tube between a retracted position and an extended position, with the fingers in the extended position being in their second position, with the fingers in the retracted position being at least partially located in and abutting with the lift tube and being in their first position.

12. The device of claim 11 wherein the moving means comprises, in combination: a rod located in the lift tube; and means for reciprocating the rod within the lift tube, with the fingers secured to and movable with the rod.

13. The device of claim 12 wherein the reciprocating means comprises a handle pivotable about a horizontal axis, with the rod having an upper end opposite the fingers, with the upper end of the rod being secured to the handle spaced from the horizontal axis.

14. Device for allowing an object to be pivoted about a vertical axis and to be positioned at variable heights comprising, in combination: a vertical tube; a plurality of indexing spacers each fabricated as a separate component, with each of the indexing spacers including an outer surface of a size and shape corresponding to and for slideable receipt inside the vertical tube, an upper end, a lower end, and an inner surface, with the plurality of indexing spacers being separably stacked along the vertical axis end-on-end in the vertical tube, with the inner surface of each of the indexing spacers including a shoulder portion extending generally perpendicular to the vertical axis and having an inner edge; and means for supporting the object and for selectively abutting with the shoulder portion of one of the indexing spacers.

15. The device of claim 14 further comprising, in combination: a tubular bushing having a cylindrical inner surface, with the tubular bushing having an outer surface of a size and shape corresponding to and for slideable receipt inside the vertical tube; and wherein the supporting and selectively abutting means comprises a lift tube having a cylindrical outer surface of a diameter for slideable receipt in the cylindrical inner surface of the tubular bushing, with the object being mounted on the lift tube.

16. The device of claim 15 wherein the spacers each include circumferentially spaced lugs extending axially from the upper end in a direction away from the lower end; and circumferentially spaced cavities extending axially from the lower end in a direction toward the upper end and having a size, shape, and position for slideable receipt of the circumferentially spaced lugs; and wherein the tubular bushing has an upper end and a lower end, with the circumferentially spaced lugs extending axially from the upper end of the tubular bushing; and wherein the tubular bushing includes circumferentially spaced troughs extending axially in the outer surface of the tubular bushing between the upper and lower ends of the bushing and having a size, shape, and position for slideable receipt of the circumferentially spaced lugs, with the circumferentially spaced lugs being circumferentially spaced from the circumferentially spaced troughs on the tubular bushing.

17. The device of claim 15 wherein the supporting and selectively abutting means includes a lower end located in the indexing spacers and vertically below the tubular bushing of a size which is unable to pass through the cylindrical inner surface of the tubular bushing.

18. The device of claim 15 wherein the supporting and selectively abutting means further comprises, in combination: a rod located in the lift tube and having a lower end; means for reciprocating the rod within the lift tube between a retracted position and an extended position; at least first and second fingers secured adjacent the lower end of the rod, with the fingers being biased from a first position to a second position, with the fingers in the first position being of a size for movement in the inner surfaces of the indexing spacers and past the inner edges of the shoulder portions without abutment and in the second position being of a size for abutting with one of the shoulder portions for preventing vertically downward movement of the fingers therebeyond, with the fingers in the extended position being in their second position, with the fingers in the retracted position being at least partially located in and abutting with the lift tube and being in their first position.

19. The device of claim 14 wherein the spacers each include circumferentially spaced lugs extending axially from the upper end in a direction away from the lower end; and circumferentially spaced cavities extending axially from the lower end in a direction toward the upper end and having a size, shape, and position for slideable receipt of the circumferentially spaced lugs.

20. Device for allowing an object to be positioned at variable heights along a vertical axis comprising, in combination: a vertical pillar having an elongated, vertically extending inner passage, with the inner passage including a plurality of vertically spaced, shoulder portions extending generally perpendicular to the vertical axis and having inner edges, with the inner passage further including an annular inner surface having a radial spacing from the vertical axis less than the radial spacing of the inner edges of the shoulder portions; at least first and second fingers located on opposite diametric sides of the vertical axis, with the object being operatively attached to the fingers; and means for moving the fingers between a first position and a second position, with the fingers in the first position being of a size for movement in the inner passage and past the inner edges of the shoulder portions without engagement and in the second position being of a size for abutting with one of the shoulder portions for preventing vertically downward movement of the fingers therebeyond, with the size of the fingers in the first position being unable to pass through the inner surface of the inner passage.

* * * * *